US007284590B2

(12) United States Patent
Liimatainen

(10) Patent No.: US 7,284,590 B2
(45) Date of Patent: Oct. 23, 2007

(54) METHOD FOR MANUFACTURING CAST COMPONENTS

(75) Inventor: Jari Liimatainen, Tampere (FI)

(73) Assignee: Metso Powdermet Oy, Tampere (FI)

( * ) Notice: Subject to any disclaimer, the term of this patent is extended or adjusted under 35 U.S.C. 154(b) by 55 days.

(21) Appl. No.: 11/283,377

(22) Filed: Nov. 21, 2005

(65) Prior Publication Data

US 2006/0108088 A1 May 25, 2006

(30) Foreign Application Priority Data

Nov. 24, 2004 (FI) ..... 20041510

(51) Int. Cl.
*B22D 19/00* (2006.01)

(52) U.S. Cl. ..... 164/98; 164/100; 164/76.1

(58) Field of Classification Search ..... 164/76.1, 164/98, 100

See application file for complete search history.

(56) References Cited

U.S. PATENT DOCUMENTS 4,314,007 A 2/1982 Gessinger
4,608,318 A * 8/1986 Makrides et al. ..... 428/553
4,630,692 A * 12/1986 Ecer ..... 175/405.1
5,241,737 A 9/1993 Colvin
5,241,738 A 9/1993 Colvin
5,263,530 A 11/1993 Colvin
5,332,022 A 7/1994 Colvin
5,850,590 A * 12/1998 Furuta et al. ..... 419/49
5,981,083 A * 11/1999 Colvin et al. ..... 428/608

FOREIGN PATENT DOCUMENTS

JP 63-169342 7/1988
JP 03-234347 10/1991
JP 09-105517 4/1997

* cited by examiner

*Primary Examiner*—Kevin Kerns
*Assistant Examiner*—I.-H. Lin
(74) *Attorney, Agent, or Firm*—Buchanan Ingersoll & Rooney PC

(57) ABSTRACT

A method for manufacturing cast components, in which method the cast mold and/or macroscopic inserts to be placed either totally or partly inside thereof are left totally or partly as a part of the final component to be used, after the casting the piece is further treated with temperature and/or pressure in order to improve the compactness of both the cast materials and the materials acting as inserts and to improve the bond between the cast material and the solid material attached thereto, and the portion of the solid or partly solid material (inserts) to be placed into the cast mold and remaining in the final component, inclusive the portion of the mold eventually remaining in the final component, of the weight of the total component is more than 3 percent by weight.

17 Claims, 1 Drawing Sheet

METHOD FOR MANUFACTURING CAST COMPONENTS

FIELD OF THE INVENTION

The present invention relates to manufacturing of components and wear parts so, that in connection with the cast and other treatments after that, solid or partially solid materials for improving the wear resistance and/or the mechanical reliability are combined with the cast material, said solid or partially solid materials achieving after the treatments after the cast the desired hardness, wear resistance, mechanical properties and jointing strength to the cast material, and in case of partially solid materials, achieving the desired compactness.

BACKGROUND OF THE INVENTION

In order to improve the wear resistance and the mechanical reliability of materials and components, the products must be in many cases manufactured with a combination structure so that tough, mechanically reliable material is used as a base, and by using a desired method, more wear resistant but more brittle and mechanically less reliable material is joined thereto.

Weld coating is one of the most commonly used methods for manufacturing coatings. Problems with the weld coatings are the restrictions with respect to the used materials and the thickness of the coating, as well as the soundness level of the coatings. In especially demanding objects, the weld coatings can even peel off due to the strong loads exerted to the surface.

Also by using cast techniques, it is possible to manufacture multi-material constructions and coatings for example by manufacturing multi-layer casts or by casting hot metal onto a solid material. Restrictions in connection with the cast materials are among others difficult manufacturability of certain forms of products. In addition, the materials to be used must naturally be suitable for casting.

With hot isostatic pressing it is possible to manufacture components having a combination structure and in many cases higher quality than with cast or welded coatings. The method has the weakness of having higher manufacturing costs.

SUMMARY OF THE INVENTION

In the method in accordance with the invention, the component is manufactured so, that onto the surface of the cast and/or inside and/or partially inside the cast there are formed materials made of one or of a plurality of wear resistant material, or respectively, the toughness and mechanical reliability improving materials, in the form of solid or alternatively partially solid materials to be solidified in the later steps of the process, in this connection referred to as inserts. These inserts are components manufactured with different methods, that can be manufactured for example by casting, with different powder metallurgical methods, among others by hot isostatic pressing or sintering, rolling or extruding. The insert materials improving the wear resistance can be tool steels, metal matrix composites (combinations of metal and ceramic), hard metals or for example white cast irons. Materials improving the toughness and the mechanical reliability can be for example steels, different nickel or cobalt-based alloys or for example the same material as the material of the mold, in which the cast is made. The materials are chosen depending on the requirements of the application, the cost targets and the geometry of the component.

The inserts are placed and formed so, that they can be made to keep in position in the cast as reliably as possible during the cast process, the after-treatment and the use. Because the insert materials are in the most cases more expensive than the cast material to be cast in the mold, the location and the amount thereof are optimized depending on the application and the product. Some coating or other material can be placed, if necessary, around the insert, in order to decrease the thermal shock and the residual stresses caused by the cast or to improve the bond strength between the insert and the cast. When using a metal plate mold for casting, the metal plate mold can be left as a part of the ready component to improve the mechanical reliability of the construction or to act as a part of the mold to be used in the hot working or in the hot isostatic pressing.

The cast can be performed in molds manufactured in different ways, like for example in a sand mold, cast iron mold or a mold made of metal plate. After the cast, the cast must be compacted, if necessary, by means of pressure and/or temperature. Alternative methods are among others the hot working, hot isostatic pressing or hot rolling. These methods can be used for improving both in case of the cast material and solid inserts the level of soundness of the inserts and to improve the bond between the inserts and the cast materials. When using hot isostatic pressing, the outer surface of the cast must be as compact as possible, because otherwise, no compacting and consolidation of the internal boundary layers can be achieved with the hot isostatic pressing, because the compressing gas penetrates inside the piece and to the boundary layers for example through the pores. Also a metal mold can be used for casting, whereby the metal mold forms a ready, gas tight capsule around the piece for example so, that only the mouth of the mold to be used for the cast must be sealed in order to form a gas tight shell around the piece. The metal mold can remain as a part of the component pressed with hot isostatic pressing, in order to improve the reliability of the structure. It is also possible to use on the surface of the mold and the cast material materials that melt during the hot isostatic pressing, said materials forming together with the metal mold a gas tight shell around the piece. In certain forms of the product it is possible with cast-technical means to produce already during the cast a gas tight shell around the piece.

BRIEF DESCRIPTION OF THE DRAWING

The invention will be described in more detail in the following, by means of example only, with reference to the enclosed drawings, wherein FIG. from 1*a* to 1*c* show steps of one method in accordance with the invention.

DESCRIPTION OF THE PREFERRED EMBODIMENTS

In the method shown in FIG. from 1*a* to 1*c*, the insert materials 1, 1' are first manufactured with some method known in the art, suitable for the material and the application in question. These are for example sintering, casting, hot isostatic pressing, extruding etc. A coating can be made around the insert, if necessary. The insert materials in question can be in different parts of the component different and made of different materials.

Figure 1A:
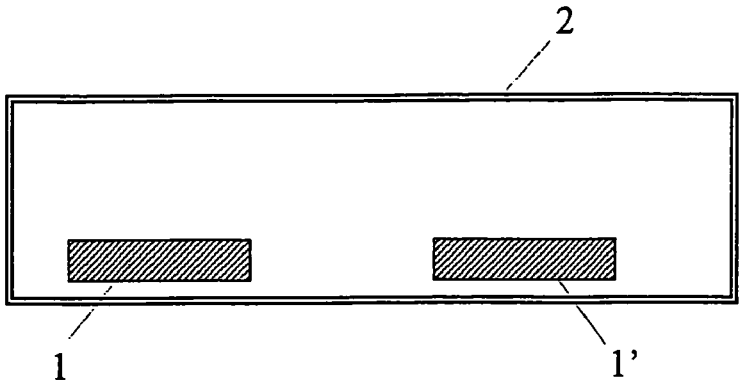

Inserts 1, 1' are placed into a mold 2 (FIG. 1*a*) manufactured with a desired method, said mold being for example a sand mold, a cast iron mold, a mold made of metal plate or some other mold. The inserts are placed into the mold either so, that they are partially on the surface of the material to be cast or totally inside the material to be cast. In addition to the inserts improving the wear resistance, for example inserts improving the toughness and mechanical reliability can be placed into the mold, if necessary, said inserts being of the same or different material as the mold. If necessary, the inserts can be attached to the mold with different mechanical attachments like with clamps, by gluing, soldering or even by welding.

Figure 1B:
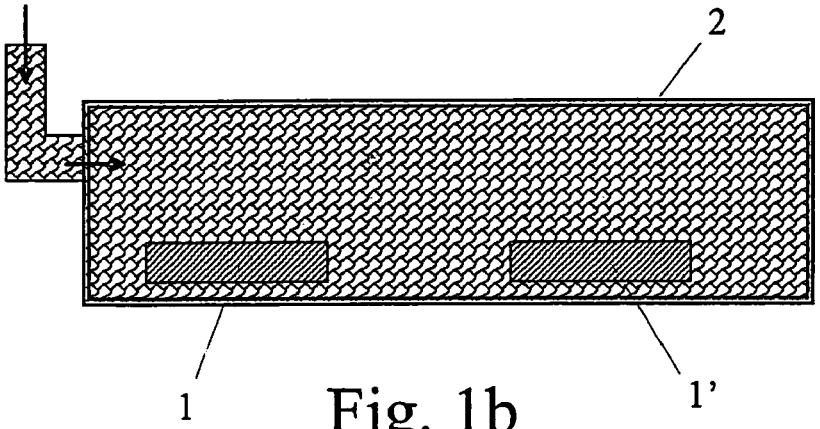

After the inserts 1, 1' have been placed into the mold 2 the hot metal is cast into the mold (FIG. 1*b*). The metal to be cast can be, depending on the application, for example of cast steel, cast iron or aluminium. The metal mold chosen in a suitable way can, if necessary, also remain as a part of the component to be cast and act as a part of the mold to be used in the hot working or hot isostatic pressing.

Figure 1C:
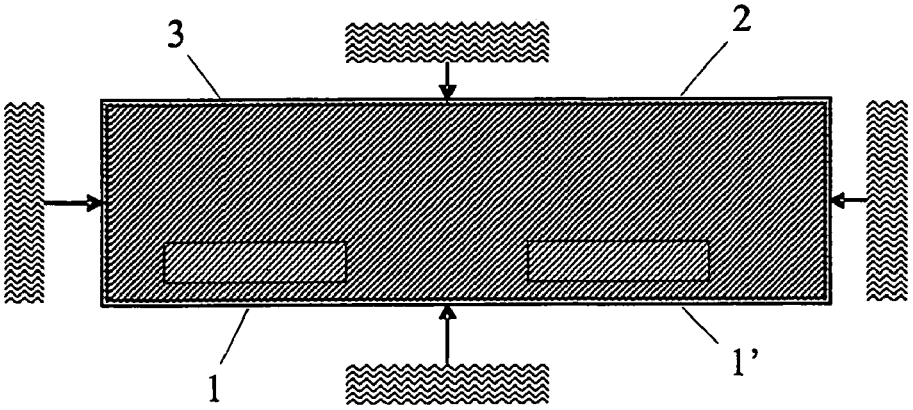

The cast component 3 can be further processed by means of temperature and/or pressure (FIG. 1*c*), if necessary, for example by means of hot isostatic pressing, hot pressing, hot working or hot extrusion in order to improve the compactness of the cast and to improve the strength of the boundary layer between the insert and the cast metal.

In the method in accordance with the invention, the hot isostatic pressing is performed in a temperature preferably at least of 50% of the melting point of the material to be cast.

The cast component can finally be machined, heat-treated or it can be, if necessary be subjected to other working steps for example for achieving the desired quality. If a metal plate mold is used, the mold can remain totally or partly as a part of the manufactured component.

In the method in accordance with the invention the insert material can be advantageously material having a portion of the cast component at least 5 percent by weight and having a hardness of at least 40 HRC after all manufacturing steps and treatments to be performed after casting. The volumetric portion of the carbides, nitrides, oxides and other ceramic particles of the wear resistant material in question is more than 10 percent by volume.

In the method in accordance with the invention, the cast material to be used is advantageously iron-based material having an iron content of more than 50 percent by weight (Fe>50 percent by weight). In addition, the portion of alloyed materials in the iron-based material to be cast in question is not more than 30 percent by weight. The material to be manufactured with the method in accordance with the invention has, among others, the following advantages:

1. The properties of the wear parts and components can be improved by combining wear resistant, more brittle and more expensive material with a tough, cheaper material.
2. Manufacturing costs of the component can be decreased, because the use of the more expensive, wear resistant material can be restricted to critical areas, and the cost efficient manufacturing method, in other words casting, can be used as basic manufacturing method.
3. The manufacturing costs with the method compared with those of a product pressed with hot isostatic pressing, produced with a powder metallurgic method and encapsuled for that purpose, are lower due to the use of the cast technique for the manufacture of the base material and because the eventual separate encapsulation can be avoided.
4. Compared with a product manufactured with solid-solid-bond and pressed with hot isostatic pressing, the manufacturing cost are lower, because it is not necessary to machine with strict dimensional tolerances the hard inserts that are difficult to machine or the cast material acting as a base.
5. The treatment after the cast with pressure and temperature improves the properties of the cast and improves the strength of the bond between the insert and the cast compared to a product manufactured without any treatment after the cast. In addition, the treatment closes eventual cracks caused to the inserts during the casting.

The material manufactured with the method in accordance with the method is suitable for use in demanding components of mining, mineral, recycling, wood processing, metallurgical and energy industry, like for example in wear parts of stone crushers, linings of grinding mills, hammer crushers, shredders, rollers and other industrial tools, cutters and rams.

The insert materials to be used in the method in accordance with the invention are preferably manufactured with powder-metallurgical methods, casting or working (rolled, hammered or extruded) of hard metals (combination material of metal and ceramic having a portion of metallic matrix less than 50 percent by weight), of ceramic materials or combinations of these materials.

The invention claimed is:

1. A method for manufacturing cast components comprising the steps of:

leaving a cast mold and/or macroscopic inserts, to be placed either totally or partly inside cast material, totally or partly as a part of a final component to be used, wherein the material to be cast is of iron-based material having an iron content of more than 50 percent by weight (Fe>50 percent by weight);

after the casting, further treating with temperature and/or pressure in order to improve compactness of both the cast materials and the solid or partial solid materials acting as inserts and to improve bond between the cast material and the solid material attached thereto, and wherein a weight of a portion of the solid or partly solid material (inserts) to be placed into the cast mold and remaining in the final component, inclusive the portion of the mold eventually remaining in the final component, to the total component is more than 3 percent by weight.

2. A method in accordance with claim 1, wherein after the cast, the material is treated with hot isostatic pressing.

3. A method in accordance with claim 2, wherein the cast material is cast into a metal mold, a part of which forming at least a part of the component and/or a part of the mold to be used in the hot isostatic pressing.

4. A method in accordance with claim 2, wherein the hot isostatic pressing is performed at a temperature of at least 50% of the melting point of the material to be cast.

5. A method in accordance with claim 2, wherein in the cast component at least 5 percent by weight is wear resistant material having a hardness of at least 40 HRC after all manufacturing steps and treatments to be performed after the cast.

6. A method in accordance with claim 2, wherein the material to be cast is of iron-based material having a portion of alloyed materials not more than 30 percent by weight.

7. A method in accordance with claim 2, wherein the insert materials are manufactured with a powder metallurgic method, by casting or by working (rolled, hammered or extruded) of hard metals (combination material of metal and ceramics having a portion of metallic matrix less than 50 percent by weight), of ceramic materials or of combinations of those materials.

8. A method in accordance with claim 1, wherein the material to be cast is of iron-based material having a portion of alloyed materials not more than 30 percent by weight.

9. A method in accordance with claim 1, wherein the insert materials are manufactured with a powder metallurgic method, by casting or by working (rolled, hammered or extruded) of hard metals (combination material of metal and ceramics having a portion of metallic matrix less than 50 percent by weight), of ceramic materials or of combinations of those materials.

10. A method in accordance with claim 1, wherein the cast material is cast into a metal mold, a part of which forming at least a part of the component and/or a part of the mold to be used in a hot isostatic pressing.

11. A method in accordance with claim 10, wherein the hot isostatic pressing is performed at a temperature of at least 50% of the melting point of the material to be cast.

12. A method in accordance with claim 10, wherein in the cast component at least 5 percent by weight is wear resistant material having a hardness of at least 40 HRC after all manufacturing steps and treatments to be performed after the cast.

13. A method in accordance with claim 10, wherein the material to be cast is of iron-based material having a portion of alloyed materials not more than 30 percent by weight.

14. A method in accordance with claim 1, wherein a hot isostatic pressing is performed at a temperature of at least 50% of the melting point of the material to be cast.

15. A method in accordance with claim 14, wherein in the cast component at least 5 percent by weight is wear resistant material having a hardness of at least 40 HRC after all manufacturing steps and treatments to be performed after the cast.

16. A method in accordance with claim 1, wherein in the cast component at least 5 percent by weight is wear resistant material having a hardness of at least 40 HRC after all manufacturing steps and treatments to be performed after the cast.

17. A method in accordance with claim 16, wherein the volumetric portion of the carbides, nitrides, oxides and other ceramic particles of the wear resistant material remaining inside the cast is more than 10 percent by volume.

* * * * *